US006006572A

United States Patent [19]

Tsuritani

[11] Patent Number: 6,006,572

[45] Date of Patent: Dec. 28, 1999

[54] SPRING MANUFACTURING MACHINE

[75] Inventor: Katsuhide Tsuritani, Osaka, Japan

[73] Assignee: Shinko Machinery Co., Ltd., Osaka, Japan

[21] Appl. No.: 09/212,658

[22] Filed: Dec. 16, 1998

[30] Foreign Application Priority Data

Jan. 13, 1998 [JP] Japan ..... 10-017816

[51] Int. Cl.[6] ..... B21F 3/02; B21D 43/00; B21D 43/16

[52] U.S. Cl. ..... 72/135; 72/419; 72/428

[58] Field of Search ..... 72/129, 133, 135, 72/137, 138, 140, 145, 419, 426, 428, 247

[56] References Cited

U.S. PATENT DOCUMENTS

| | | | |
|---|---|---|---|
| 4,503,694 | 3/1985 | Takumi | 72/137 |
| 5,363,681 | 11/1994 | Speck et al. | 72/129 |
| 5,816,091 | 10/1998 | Sautter et al. | 72/129 |
| 5,829,294 | 11/1998 | Bradbury et al. | 72/247 |

*Primary Examiner*—Rodney Butler
*Attorney, Agent, or Firm*—Clifford W. Browning; Woodard, Emhardt, Naughton, Moriarty & McNett

[57] ABSTRACT

A spring manufacturing machine enhances an efficiency of operation. A desired one of wire passages in wire feeding rollers is aligned with a wire passage in an auxiliary wire guide and a wire passage in a final wire guide by adjusting a position of a forward and rearward movable table with respect to a front wall of a machine frame.

8 Claims, 7 Drawing Sheets

SPRING MANUFACTURING MACHINE

BACKGROUND OF THE INVENTION

1. Field of the Invention

The present invention relates to a spring manufacturing machine.

2. Description of the Prior Art

Conventionally, as a spring manufacturing machine of this kind, there has been known the following structure. That is, there has been known a structure comprising a machine frame having a vertical front wall, a wire processing space formed in front of the front wall of the machine frame, a final wire guide having a wire passage for guiding a wire fed out toward the wire processing space and detachably provided in the front wall, at least a pair of wire feeding roller rotatably provided in the front wall at an opposite side of the final wire guide to the wire processing space and feeding out the wire by holding it therebetween, at least one slide for a bending die opposing to the wire guide with respect to the wire processing space, provided in the front wall so as to freely move forward and backward with respect to the wire processing space and mounting the bending die, at least one cutter mounting slide provided in the front wall so as to freely move forward and backward with respect to the wire processing space and mounting a cutter, at least one forming tool mounting slide provided in the front wall so as to freely move forward and backward with respect to the wire processing space and mounting a forming tool, and a pitch tool mounting rod provided near the wire processing space of the final wire guide so as to freely move forward and backward with respect to the front wall and mounting a pitch tool, in which an annular groove for a wire is formed around an outer peripheral surface of the wire feeding roller (refer to Japanese Patent Publication No. 4858/1989).

OPERATION OF SPRING MANUFACTURING MACHINE

A basic operation of the spring manufacturing machine will be described below.

A wire (a material to be processed) in a state of being held between the wire feeding rollers is fed out to the wire processing space through the final wire guide by the rotation of the wire feeding rollers. Then, a predetermined process is performed to the wire fed out to the wire processing space or being fed out thereto by various kinds of tools including the bending die protruding to the wire processing space or in a protruded state, whereby a spring (normally a spring having a front foot such as a front hook and the like, a coil portion (a spring body) continuing thereto and a rear foot such as a rear hook and the like continuing thereto) is formed.

The wire continuously fed out toward the bending die is brought into contact with the bending die and continuously curved, whereby the coil portion is formed.

The wire fed out toward the bending die and the forming tool is brought into contact with the bending die and the forming tool and curved, whereby a curved portion of the front foot and the rear foot is formed, a straight portion of the front foot and the rear foot is formed when the wire is fed out to the wire processing space in a state that all the tools are not brought into contact with the wire, and a bent portion of the front foot and the rear foot is formed by bending the wire fed out to the wire processing space and stopping there by means of one or two forming tools.

A cutting of the wire is performed by cutting the stopping wire by means of a cutter.

A pitch of the coil portion is adjusted by adjusting a front position and a rear position of the pitch tool with which the coil portion is brought into contact.

ADJUSTMENT OF SPRING MANUFACTURING MACHINE

In order to smoothly feed out the wire to the wire processing space without damaging, an adjusting operation for completely connecting a wire passage for the final wire guide to a wire passage formed by the annular groove for the wire at a portion in which a pair of wire feeding rollers abut against each other in a linear manner, so-called, a wire-line aligning operation is indispensable.

In this case, the annular groove for the wire is formed in a shape to which a half of the wire having a circular cross section is fitted, and the wire passage for the final wire guide is formed in a shape through which the wire having a circular cross section passes. In this case, the final wire guide is generally constituted by combining a pair of elements of a shape obtained by being separated by an imaginary cross sectional line passing through a center of the wire passage.

DISADVANTAGES OF THE PRIOR ART

There has been the following disadvantage in the conventional spring manufacturing machine mentioned above. That is, a replacement of the wire feeding rollers and the wire-line aligning operation must be performed at every time when the diameter of the wire is changed, a lot of time is required for performing the operation and the spring manufacturing machine can not be operated during the operation, so that an operational efficiency in the spring manufacturing machine is lowered.

Further, in the case that the inner peripheral surface of the annular groove for the wire of the wire feeding roller is broken, it is necessary to replace the wire feeding rollers and perform the wire-line aligning operation, as a result, there has been the same disadvantage as that mentioned above.

SUMMARY OF THE INVENTION

In order to overcome the disadvantage mentioned above, the present invention uses the following means.

In accordance with a first aspect of the present invention, there is provided a spring manufacturing machine comprising: a machine frame having a vertical front wall; a wire processing space formed in front of the front wall of the machine frame; a final wire guide provided in the front wall and guiding a wire fed out toward the wire processing space; at least one slide for a bending die provided in the front wall so as to freely move forward and backward with respect to the wire processing space; and at least one cutter mounting slide provided in the front wall so as to freely move forward and backward with respect to the wire processing space, wherein a forward and rearward movable table is provided in the machine frame so as to freely move forward and rearward at the back of the front wall, at least a pair of roller shafts having an axis in a forward and rearward direction are rotatably provided in the forward and rearward movable table, front end portions of the roller shafts protrudes forward of the front wall through an opening formed in the front wall at an opposing side of the final wire guide to the wire processing space, a wire feeding roller for feeding the wire toward the final wire guide while holding the wire therebetween is fitted to the front end portions of the roller shafts, and at least two annular grooves for a wire are formed around an outer peripheral surface of each of the wire feeding rollers.

In accordance with a second aspect of the present invention, there is provided a spring manufacturing machine as stated in the first aspect, in which a pressing roller directing the axis indirectly or directly provided in the front wall so as to freely rotate in a forward and rearward direction is brought into contact with an outer peripheral surface in a side not mutually opposing to each other of a pair of wire feeding rollers, so that a pair of wire feeding rollers are not mutually apart from each other.

In accordance with a third aspect of the present invention, there is provided a spring manufacturing machine as stated in the first aspect or the second aspect, in which the wire feeding rollers is constituted by at least two roller elements, and at least one annular groove for a wire is formed in the roller elements.

In accordance with the present invention, the following effects can be obtained by the structure mentioned above.

In accordance with the first aspect of the present invention, since the wire feeding rollers can be moved forward and rearward by moving the forward and rearward movable table in a forward and rearward direction so as to align a desired annular groove for the wire of the wire feeding rollers to the wire passage of the final wire guide, that is, a replacing operation of the wire feeding roller is not required, it is possible to make the replacing operation of the wire feeding roller and the adjusting operation together therewith significantly less than the conventional art, thereby increasing an efficiency of an operation of the spring manufacturing machine.

In accordance with the second aspect of the present invention, since the structure is made such that a pair of wire feeding rollers for feeding out the wire toward the final wire guide while pressing the wire therebetween is supported by the pressing roller, it is possible to prevent a pair of wire feeding rollers from mutually moving apart from each other.

In accordance with the third aspect of the present invention, since the wire feeding rollers are constituted by at least two roller elements, in the case that a damage is caused in the inner peripheral surface of any one of the annular grooves for the wire, it is sufficient to replace only the corresponding roller element, so that the structure is economical. That is, unless the wire feeding rollers are constituted by the roller elements, due to one of the annular grooves for the wire in which a damage is caused on the inner peripheral surface, it is necessary to replace a whole of the wire feeding rollers including the wire feeding roller having no damage on the other annular groove for the wire. In accordance with the third aspect of the present invention, the above disadvantage can be avoided.

DESCRIPTION OF THE PREFERRED EMBODIMENT

An embodiment in accordance with the present invention will be described below with reference to the accompanying drawings.

Figure 1:
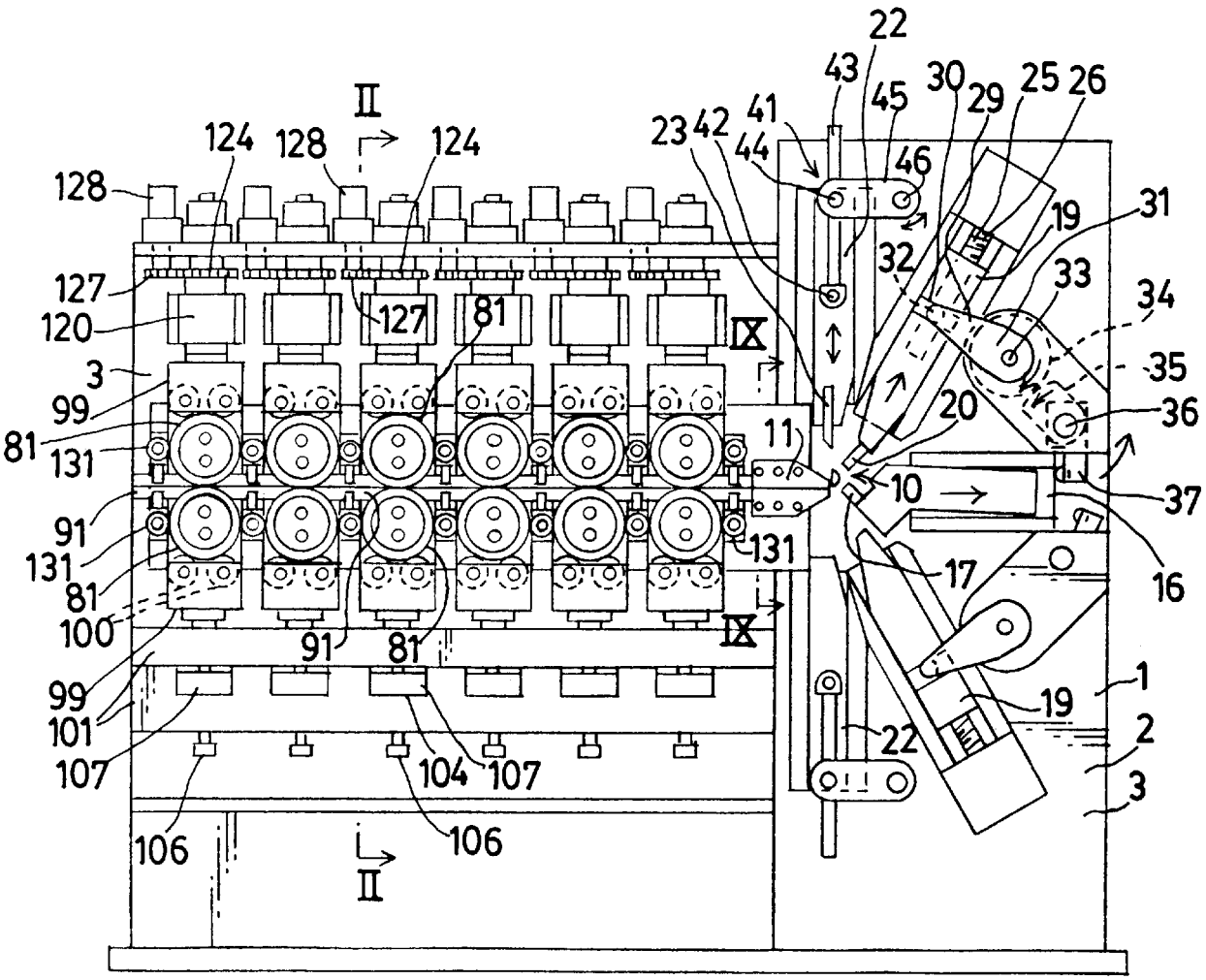
FIG. 1 is a plan view which shows an embodiment in accordance with the present invention.

In this description, a front, a rear, a left and a right respectively correspond to a bottom part of FIG. 1, an upper part of the same, a left side of FIG. 1 and a right side of FIG. 1.

As shown in FIG. 1, a spring manufacturing machine 1 comprises a machine frame 2 having a vertical front wall 3, a wire processing space 10 formed in front of the front wall 3, a final wire guide 11 (refer to FIG. 9) having a wire passage 12 through which a wire W fed out toward the wire processing space 10 passes, and detachably fixed to a mounting table portion 13 of the front wall 3 by means of a bolt 14 or the like, a slide 16 for a first bending die opposing to the final wire guide 11 with respect to the wire processing space 10, provided in the front wall 3 so as to freely move forward and backward with respect to the wire processing space 10 and to which a first bending die 17 is mounted, an upper slide 19 for a second bending die opposing to the final wire guide 11 with respect to the wire processing space 10, provided in the front wall 3 so as to freely move forward and backward with respect to the wire processing space 10 and to which a second bending die 20 is mounted, and an upper cutter mounting slide 22 provided in the front wall 3 so as to freely move forward and backward with respect to the wire processing space 10 and to which a cutter 23 is mounted.

In this case, as is known, a pitch tool mounting rod (not shown) to which a pitch tool (not shown) is mounted is provided near the wire processing space 10 of the final wire guide 11 so as to freely move forward and rearward with respect to the front wall 3.

Figure 9:
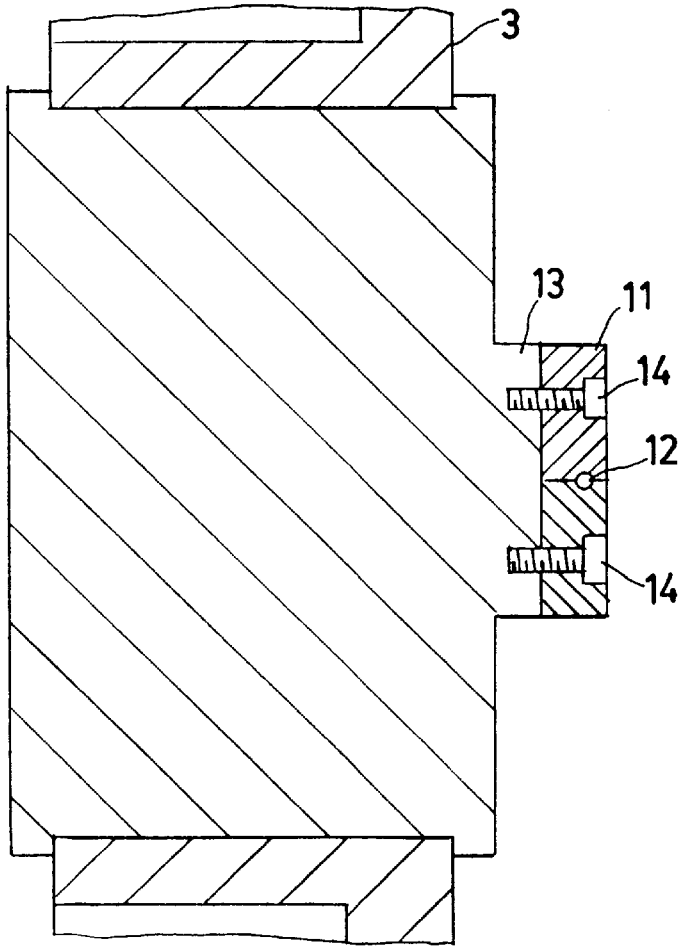
FIG. 9 is a cross sectional view taken along a line IX—IX in FIG. 1.

The final wire guide 11 is constituted by combining a pair of elements which are of a shape obtained by being separated by an imaginary horizontal cross sectional line passing through a center of the horizontal wire passage 12 (refer to FIG. 9).

The slide 19 for the second bending die is structured to be freely moved forward and rearward with respect to the wire processing space 10 by a known slide operating apparatus 25. The slide operating apparatus 25 has a ball screw 26 rotatably provided in the front wall 3, a female screw mechanism (not shown) engaging with the ball screw 26 and provided in the side of the slide 19 for the second bending die, and a motor (not shown) rotating the ball screw 26 and freely rotatable in a normal and inverse direction.

In accordance with the structure mentioned above, it is possible to operate the slide 19 for the second bending die by normally and inversely rotating the ball screw 26.

The slide 19 for the second bending die and the slide 16 for the first bending die are structured so as to operate via a known power transmitting mechanism 29 which is described in detail below in an interlocking manner.

A groove 30 perpendicular to a moving direction of the slide 19 for the second bending die is formed on the front surface of the slide 19 for the second bending die, a roller 32 which directs an axis rotatably provided at a free end of a swing lever 31 in a forward and rearward direction is fitted to the groove 30 in a state that no play is present in a widthwise direction of the groove 30, a base portion of the swing lever 31 is fixed to a rotating shaft 33 having an axis in a forward and rearward direction, and the rotating shaft 33 is rotatably provided in the front wall 3.

A gear 34 is detachably fitted to the rotating shaft 33 so as to easily break a power transmission, a fan gear 35 is engaged with the gear 34, a base portion of the fan gear 35 is fixed to a rotating shaft 36 having an axis in a forward and rearward direction, the rotating shaft 36 is rotatably provided in the front wall 3, a swing lever 37 is fixed to the rotating shaft 36, and a free end of the swing lever 37 opposes to a right end of the slide 16 for the first bending die.

The slide 16 for the first bending die is urged to a direction of moving apart from the wire processing space 10, that is, rightward by a spring (not shown) so as to be brought into contact with the free end of the swing lever 37.

In accordance with the structure mentioned above, when the slide 19 for the second die moves in a direction of moving apart from the wire processing space 10, the slide 16 for the first bending die also moves in a direction of moving apart from the wire processing space 10 in an interlocking manner. Further, inversely, when the slide 19 for the second bending die moves in a direction of moving close to the wire processing space 10, the slide 16 for the first bending die also moves in a direction close to the wire processing space 10 in an interlocking manner.

The slide 22 for the cutter is structured such as to freely move forward and rearward with respect to the wire processing space 10 by a known slide operating apparatus 41 which described is in detail below.

An end of a connection rod 43 is connected to the slide 22 for the cutter by a connection pin 42 having an axis in a forward and rearward direction, the other end of the connection rod 43 is connected to a swing lever 45 by a connection pin 44 having an axis in a forward and rearward direction, and a base portion of the swing lever 45 is fixed to a rotating shaft 46 having an axis in a forward and rearward direction. The rotating shaft 46 is structured so as to freely rotate with respect to the front wall 3, and to directly or indirectly rotate within a predetermined angle range by a motor (not shown) in a normal and inverse direction (a normal and inverse rotation being not a 360 degree full rotation).

In accordance with the structure mentioned above, it is possible to move the slide 22 for the cutter forward and rearward with respect to the wire processing space 10 by normally and inversely rotating the rotating shaft 46 within a predetermined angle range.

A lower slide 19 for a second bending die and a lower slide 22 for a cutter which is used at a time of changing a use state of the spring manufacturing machine 1 in a state of being a line symmetrical to an upper slide 19 for the second bending die and an upper slide 22 for the cutter with setting an imaginary horizontal line including a center of the wire processing space 10 to be a symmetrical axis, that is, which is not used in the state shown in the drawing, are provided in the front wall 3.

A structure of the lower slide 19 for the second bending die is the same as that of the upper slide 19 for the second bending die, and a structure of the lower slide 22 for the cutter is the same as that of the upper slide 22 for the cutter.

Figure 2:
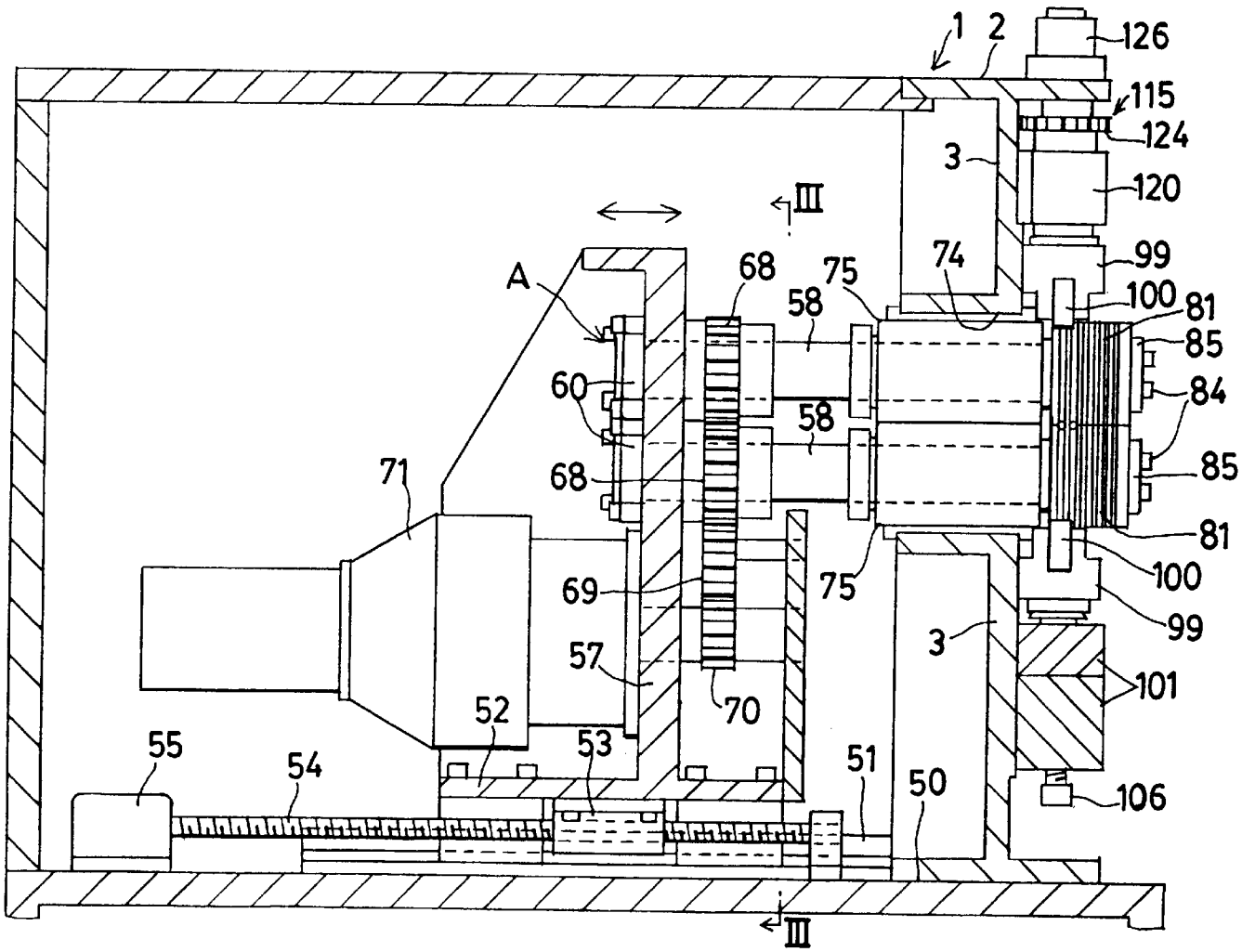
FIG. 2 is an enlarged cross sectional view taken along a line II—II in FIG. 1.
Figure 3:
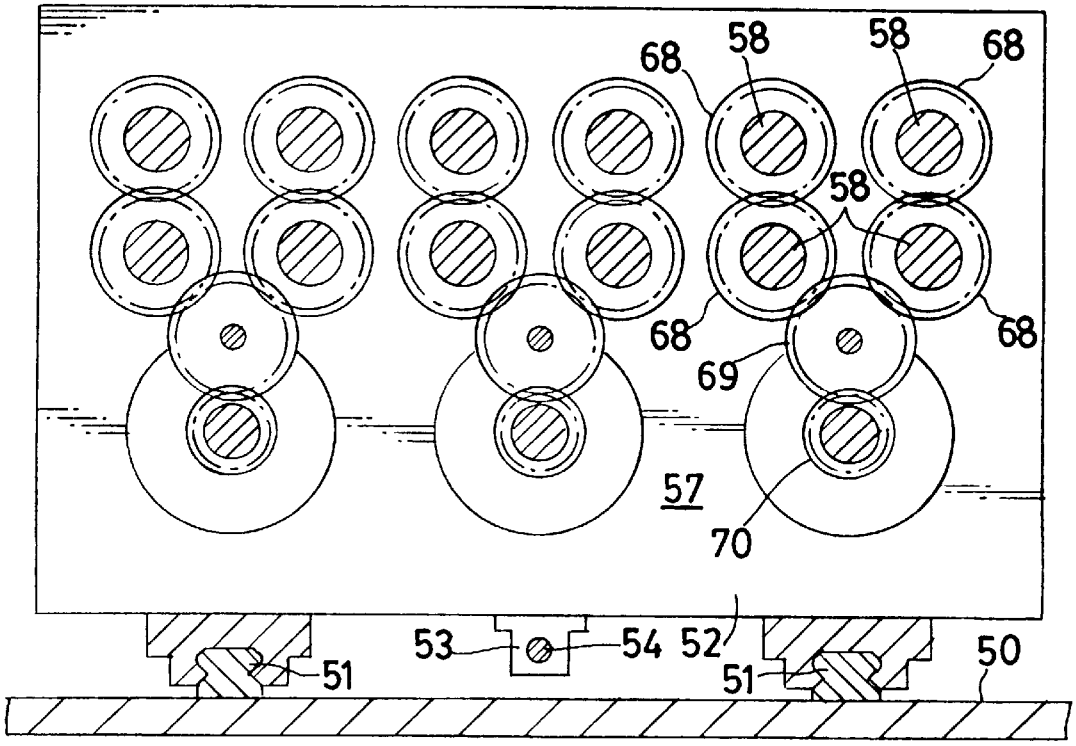
FIG. 3 is an enlarged cross sectional view taken along a line III—III in FIG. 2.

As shown in FIGS. 2 and 3, a pair of right and left guide rails 51 having a longitudinal direction corresponding to a forward and rearward direction is provided in a horizontal wall 50 of the machine frame 2 (positioned at the back of the front wall 3), a forward and rearward movable table 52 is provided so as to freely move along the guide rail 51, a female screw member 53 having an axis in a forward and rearward direction is provided in the forward and rearward movable table 52, a ball screw 54 having an axis in a forward and rearward direction is threaded and fitted to the female screw member 53, and the ball screw 54 is fixed to a rotating shaft of a motor 55 fixed to the horizontal wall 50, freely rotating in a forward and inverse direction and installing a brake apparatus (not shown) therein.

In accordance with the structure mentioned above, it is possible to move the forward and rearward movable table 52 forward and rearward by normally and inversely rotating the ball screw 54. And, when the motor 55 is stopped, the brake apparatus installed in the motor 55 operates so that the ball screw 54 does not rotate, as a result, it is structured such that the forward and rearward movable table 52 finally keeps a stopping state.

At least a pair of upper and lower (for example, six pairs of upper and lower) roller axes 58 having an axis in a forward and rearward direction is rotatably provided in a vertical wall 57 of the forward and rearward movable table 52.

Figure 4:
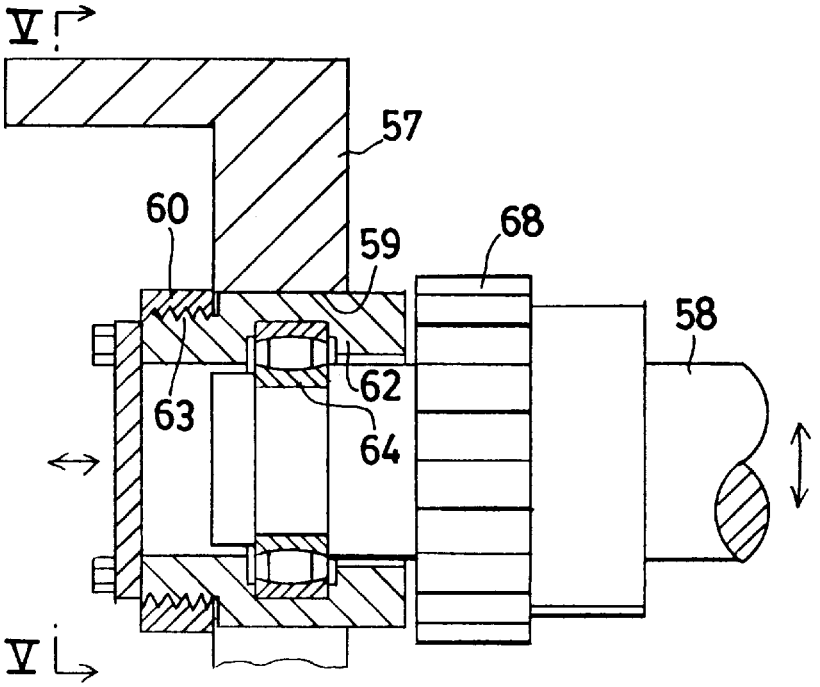
FIG. 4 is an enlarged cross sectional view of the portion A in FIG. 2.
Figure 5:
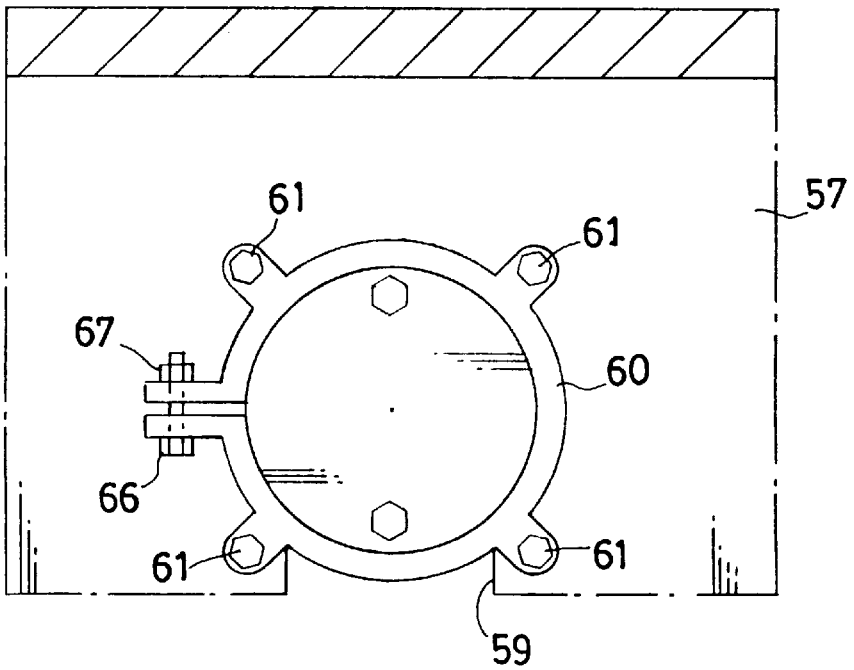
FIG. 5 is a cross sectional view taken along a line V—V in FIG. 4.

As shown in FIGS. 4 and 5, an opening 59 to which a pair of upper and lower roller axes 58 are fitted is formed on the vertical wall 57, a female screw body 60 formed in a discontinuous annular shape (having a slit) is fixed to upper and lower edge portions of the opening 59 by a desired number of bolts 61, a female screw portion 63 of a bearing 62 is threaded and fitted to the female screw body 60, and a rear and portion of the roller shaft 58 is provided in the bearing 62 so as to freely rotate through a bearing 64 allowing a slight vertical swing of the roller shaft 58. In this case, the roller shaft 58 is structured so as not to move forward and rearward with respect to the bearing 62. The female screw body 60 is connected by a fastening bolt 66 and a nut 67 as shown in FIG. 5.

In accordance with the structure mentioned above, a fine adjustment of a forward and rearward position of the bearing 62 (the roller shaft 58) can be performed by rotating the bearing 62 in a state of loosening the fastening bolt 66 and the nut 67. Then, after the adjustment, the bearing 62 can be fixed to the female screw body 60 by fastening the fastening bolt 66 and the nut 67, bending the female screw body 60 and fastening the male screw portion 63 by the female screw body 60.

As shown in FIGS. 2 and 3, a pair of upper and lower roller axes 58 are structured such as to mutually rotate in an opposite direction by the same gear 68 fitted and fastened to the roller axes and mutually engaging with each other. Idle gears 69 provided so as to freely rotate with respect to the vertical wall 57 are engaged with the lower gear 68 of a mutually adjacent set of roller axes 58, a driving gear 70 is engaged with each of the idle gears 69, and the driving gear 70 is rotated by a motor 71 (fixed to the vertical wall 57). In this case, the upper roller shaft 58 rotates in a counterclockwise direction in FIG. 1, and the lower roller shaft 58 rotates in a clockwise direction in FIG. 1.

Figure 6:
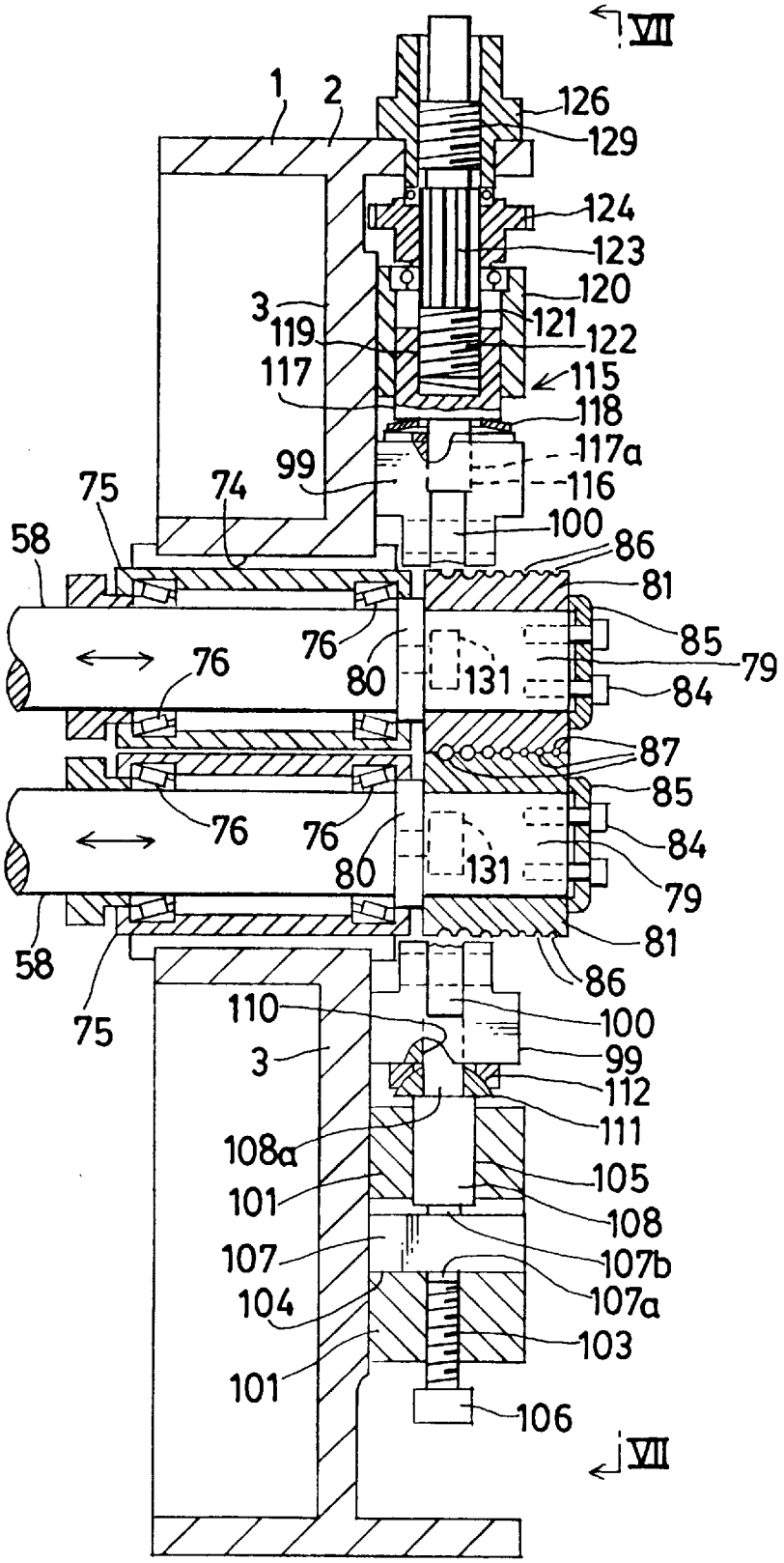
FIG. 6 is an enlarged cross sectional view of the front portion in FIG. 1.

As shown in FIG. 6, a front end portion of the roller shaft 58 protrudes forward of the front wall 3 through an opening 74 formed in the front wall 3, bearings 75 are fitted to portions opposing to the opening 74 in the roller shaft 58 through a bearing 76, and the bearings 75 are structured so as not to move in a lateral direction within the opening 74 but to move in a vertical direction. In this case, a shape of the bearing 75 as seen from a front surface is formed in a rectangular shape. Further, the bearing 75 is structured such as not to move relative to the roller shaft 58.

A fitting portion 79 is provided in the front end portion of the roller shaft 58, a flange 80 is provided in a rear portion of the fitting portion 79, an annular wire feeding roller 81 is fitted to the fitting portion 79, and the wire feeding roller 81 is held and fixed between the flange 80 and a pressing plate 85 detachably fixed to the front end of the fitting portion 79 by a bolt 84 and the like. In this case, the wire feeding roller 81 is structured so as not to relatively rotate with respect to the fitting portion 79 by a known rotation preventing mechanism (not shown) such as a spline and the like. Further, the wire feeding roller 81 is structured such as to have a size sufficient to be fitted into the opening 74.

At least two, for example, seven annular grooves 86 for a wire are formed on an outer peripheral surface of the wire feeding roller 81. A wire passage 87 is formed by the annular grooves 86 for the wire in a portion in which a pair of upper and lower wire feeding rollers 81 are faced to each other. The annular groove 86 for the wire is formed in a shape sufficient that almost half of the wire W having a circular cross section is fitted therein. In this case, at a time of attaching numerals 1 to 7 to the wire passages 87 of each of a pair of upper and lower wire feeding rollers 81 successively from a front side, it is structured such that center lines of the wire passages 87 having the same numeral in the laterally aligned wire feeding rollers 81 are aligned on the same straight line. Further, the annular grooves 86 for the wire having the different numerals are regarded as those corresponding to the wires W having the different diameters, however, it is possible to regard the annular grooves 86 for the wire having the different numerals as those of the wires W having the same diameter.

Figure 7:
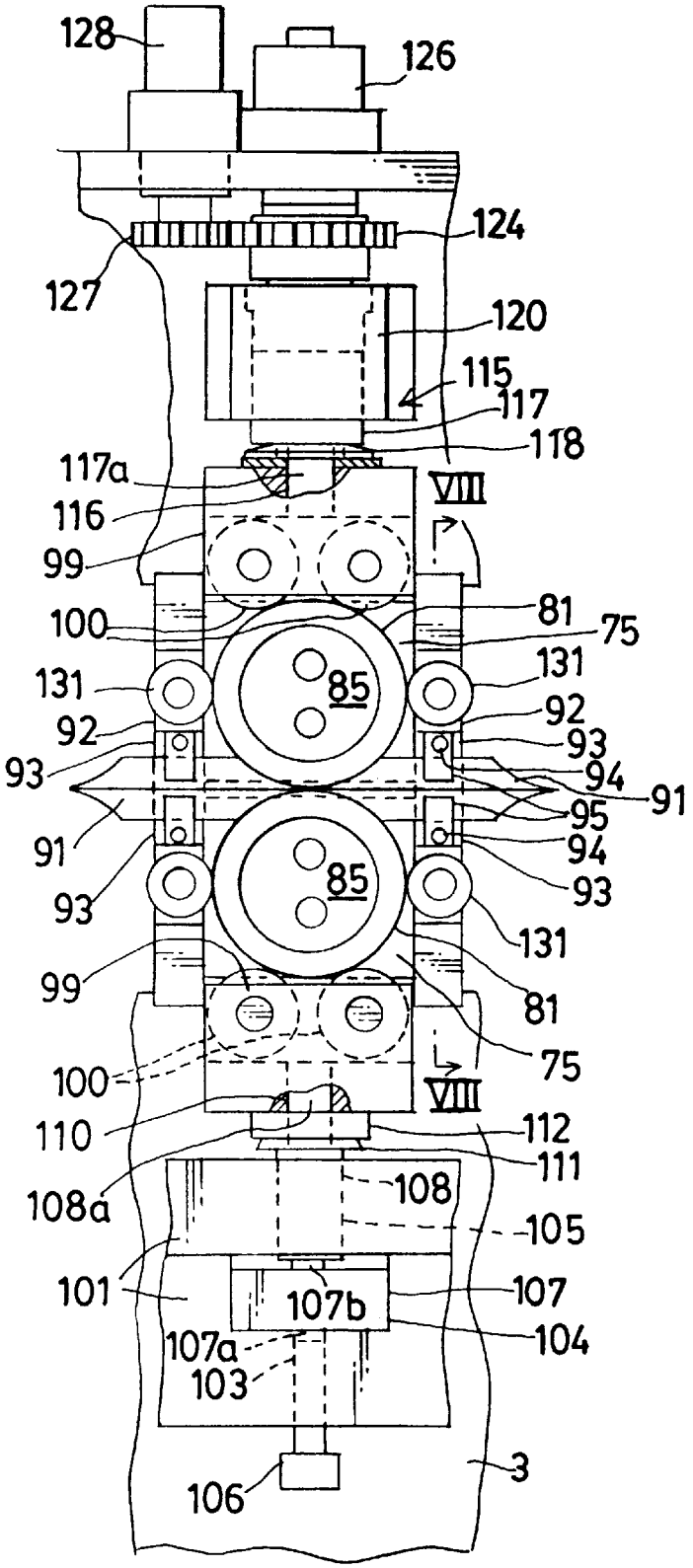
FIG. 7 is a cross sectional view taken along a line VII—VII in FIG. 6.
Figure 8:
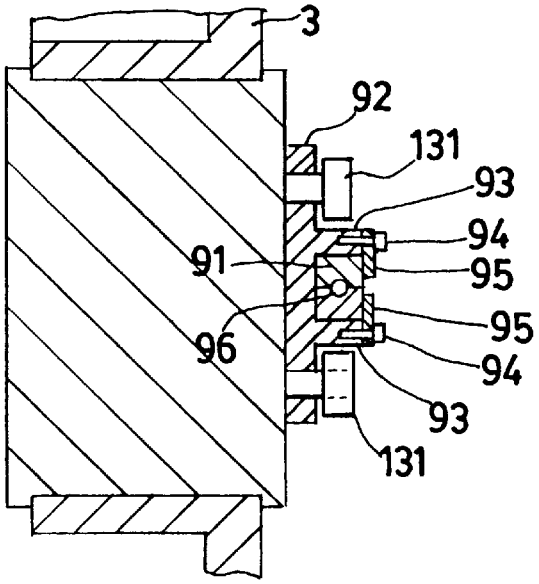
FIG. 8 is a cross sectional view taken along a line VIII—VIII in FIG. 7.

As shown in FIGS. 1, 7 and 8, an auxiliary wire guide 91 is provided between the six sets of wire feeding rollers 81 disposed in a lateral direction, in a left side portion of the leftmost wire feeding roller 81 and between the rightmost wire feeding roller 81 and the final wire guide 11 in a manner mentioned below. That is, a mounting member 92 is provided in the front wall 3 (a portion in which the auxiliary wire guide 91 is provided), and a pair of upper and lower projecting portions 93 are provided in each of the mounting members 92 in a forward projecting manner with an interval at which the auxiliary wire guide 91 can enter. The auxiliary wire guide 91 is fitted between the upper and lower projecting portions 93, and the auxiliary wire guide 91 is pressed by a pressing piece 95 detachably fixed to the front end of the projecting portion 93 by the bolt 94.

A wire passage 96 is formed in the auxiliary wire guide 91. The auxiliary guide 91 is constituted by combining a pair of elements obtained by being separated by an imaginary horizontal cross sectional line passing through a center of the wire passage 96. In this case, it is structured such that a center line of the wire passage 96 of each of the auxiliary wire guide 91 and a center line of the wire passage 12 of the final wire guide 11 are aligned on a straight line. Further, a center line of the wire passage 87 and a center line of the wire passage 96 and the wire passage 12 are positioned on the same imaginary horizontal surface.

In accordance with the structure mentioned above, it is possible to connect a predetermined one among the wire feeding roller 81 and the wire passage 87 to the wire passage 96 of the auxiliary wire guide 91 and the wire passage 12 of the final wire guide 11 on a straight line by adjusting the front and rear position of the forward and rearward movable table 52. In this case, in the auxiliary wire guide 91 and the final wire guide 11. Needless to say, ones having the wire passage 96 and the wire passage 12 corresponding to the wire W having the same diameter as that of the wire passage 87 arranged on a straight line with respect to the auxiliary guide 91 and the final wire guide 11 are selected and mounted.

As shown in FIGS. 6 and 7, a bearing member 99 slidably brought into contact with the front wall 3 and freely moving in a vertical direction is provided above and below a pair of upper and lower wire feeding rollers 81, two pressing rollers 100 are rotatably provided in each of the bearing members 99 in a state of having an axis in a forward and rearward direction. The lower pressing roller 100 is structured so as to be brought into contact with a lower outer peripheral surface of the lower wire feeding roller 81 (an outer peripheral surface not mutually opposing to each other of the wire feeding roller 81), and the upper pressing roller 100 is structured so that the upper pressing roller is brought into contact with an upper outer peripheral surface of the upper wire feeding roller 81 (an outer peripheral surface not mutually opposing to each other of the wire feeding roller 81).

A laterally oblong projecting portion 101 is projected from the front wall 3 so as to be positioned below the lower bearing member 99, and a screw hole 103 having an axis in a vertical direction, a sensor receiving recess portion 104 and a hole 105 having an axis in a vertical direction are formed in the projecting portion 101 successively from the lower side in such a manner as to correspond to each of the bearing members 99.

A bolt 106 is threaded to the screw hole 103, a pressure sensor 107 is received in the sensor receiving recess portion 104, and a support shaft 108 is fitted to the hole 105. A lower projection 107*a* of the pressure sensor 107 is fitted to the screw hole 103 and brought into contact with an upper end of the bolt 106. Further, a pressure sensitive projection 107*b* of the pressure sensor 107 is brought into contact with a lower end of the support shaft 108. A thin shaft upper portion 108*a* of the support shaft 108 is fitted to a hole 110 formed in the lower bearing member 99. An annular body 111 having an upper surface constituted by a part of a spherical surface and an annular body 112 having a recess portion to which an upper surface of the annular body 111 is aligned and fitted are fitted to the thin shaft upper portion 108*a*.

In accordance with the structure mentioned above, it is possible to adjust a vertical position of the lower bearing member 99 (the lower pressing roller 100) through the pressure sensor 107 and the supporting shaft 108 by normally and inversely rotating the bolt 106.

The pressure sensor 107 is structured such as to be used at a time of detecting a pressure acting on a pair of upper and lower wire feeding roller 81, displaying a pressure on a pressure display device (not shown) on the basis of a detected signal and performing a feed-back control of a pressurizing apparatus 115 mentioned below.

The upper bearing member 99 is urged downward by the pressurizing apparatus 115 described in detail below, and it is structured such that the pressing roller 100 is brought into contact with the upper wire feeding roller 81.

A hole 116 having an axis in a vertical direction is formed in the upper bearing member 99, a spring 118 such as a disc spring and the like is mounted on an upper surface of the upper bearing member 99 so as to be coaxial with the hole 116, a thin shaft lower portion 117*a* of a lower shaft body 117 is fitted and fastened to the hole 116 from the above of the spring 118 so as not to rotate relative to the upper bearing member 99, and a large diameter portion above the thin shaft lower portion 117*a* is brought into contact with the spring 118. A large diameter portion above the lower shaft body 117 is fitted to a supporting cylinder 120 provided in the front wall 3 so as to freely move in a vertical direction.

An upwardly open screw hole 119 is formed in the large diameter portion above the lower shaft body 117, and a lower male screw portion 122 of an upper shaft body 121 rotatably provided in the supporting cylinder 120 is threaded and fitted to the screw hole 119. A middle portion of the upper shaft body 121 is formed as a spline shaft portion 123, the spline shaft portion 123 is fitted to a gear 124 in such a manner as to freely move in a vertical direction but not relatively rotate. The gear 124 is structured so as to be restricted a position between the supporting cylinder 120 and a female screw cylinder 126 provided in the machine frame 2 so as not to move in a vertical direction. A driving gear 127 is engaged with the gear 124, and the driving gear 127 is structured so that the driving gear 127 is rotated by a motor 128 freely rotating in a normal and inverse direction (fixed to the machine frame 2) with a brake apparatus.

An upper male screw portion 129 of the upper shaft body 121 is threaded and fitted to the female screw cylinder 126.

The lower male screw portion 122 and the upper male screw portion 129 are both screws having the same spiral direction, for example, right-handed screws, however, it is structured such that a pitch of the upper male screw portion 129 is slightly larger (longer) than a pitch of the lower male screw portion 122.

In accordance with the structure mentioned above, for example, when rotating the upper shaft body 121 for a time in a clockwise direction as seen in a plan view, it is structured such that the lower shaft body 117 fixed to the upper bearing member 99 is pressed down at a degree of subtracting the pitch of the lower male screw portion 122 from the pitch of the upper male screw portion 129. Inversely, when rotating the upper shaft body 121 for a time in a counterclockwise direction as seen in a plan view, it is structured such that the lower shaft body 117 fixed to the upper bearing member 99 is pressed up at a degree of subtracting the pitch of the lower male screw portion 122 from the pitch of the upper male screw portion 129. As mentioned above, a force that the upper pressing roller 100 presses the upper wire feeding roller 81 can be adjusted through the spring 118 by adjusting the height of the lower shaft body 117.

A pressing roller 131 indirectly or directly directing the axis in a forward and rearward direction to the front wall 3 is brought into contact with the right and left side portions of each of the wire feeding rollers 81.

The spring itself is manufactured in the same manner same to that of the conventional spring manufacturing machine.

A modified embodiment will be described below.

(1) The wire feeding roller 81 may be constituted by at least two annular roller elements obtained by being separated in an axial direction, and by overlapping the annular roller elements so as to form at least one annular groove 86 for the wire on an outer peripheral surface of each of the annular roller elements.

(3) At least one slide for the bending die is sufficient. At least one slide for the cutter is also sufficient. In this case, a slide for a forming tool may be independently provided.

(4) At least a pair of wire feeding rollers 81 are sufficient.

(5) The structure may be made such that a shaft having an axis in a forward and rearward direction is provided in the front wall 3, the pressing roller 100 is rotatably provided in the shaft, a shaft having an axis in a forward and rearward direction is rotatably provided in the front wall 3, and the pressing roller 100 is fitted and fastened to the shaft. Further, the shaft may be structured such as to freely change a position to the front wall 3.

(6) The structure of the pressurizing apparatus 115 is optional.

What is claimed is:

1. A spring manufacturing machine comprising: a machine frame having a vertical front wall; a wire processing space formed in front of the front wall of the machine frame; a final wire guide provided in said front wall and guiding a wire fed out toward the wire processing space; at least one slide for a bending die provided in said front wall so as to freely move forward and backward with respect to the wire processing space; and at least one cutter mounting slide provided in said front wall so as to freely move forward and backward with respect to the wire processing space; in combination with a forward and rearward movable table provided in the machine frame so as to freely move forward and rearward perpendicularly with respect to a backside of the front wall, at least a pair of roller shafts having an axis in a forward and rearward direction of said backside of said front wall and rotatably provided in the forward and rearward movable table; front end portions of the roller shafts protruding forward of the front wall through an opening formed in the front wall at an opposing side of the final wire guide to the wire processing space; at least one wire feeding roller for feeding the wire toward the final wire guide while holding the wire therebetween, said wire feeding roller being fitted to each of said front end portions of the roller shafts; and at least two annular grooves for a wire are formed around an outer peripheral surface of each of said wire feeding rollers.

2. A spring manufacturing machine as claimed in claim 1, wherein an axis of a pressing roller is directed to the front wall and is indirectly or directly provided in the front wall so as to freely rotate about said axis and is brought into contact with an outer peripheral surface in a side not mutually opposing to each other of said pair of wire feeding rollers, so that a pair of wire feeding rollers are not mutually apart from each other.

3. A spring manufacturing machine as claimed in claim 1, wherein each of said wire feeding rollers consist of at least two roller elements, and wherein each roller element has at least one annular groove for a wire.

4. A spring manufacturing machine as claimed in any one of claims 1, 2, or 3 wherein auxiliary wire guides are disposed between said wire feeding rollers and between said final wire guide.

5. A spring manufacturing machine as claimed in any one of claims 1, 2, or 3, wherein a slide for a forming tool is further independently provided.

6. A spring manufacturing machine as claimed in claim 2, wherein each of said wire feeding rollers consist of at least two roller elements, and wherein each roller element has at least one annular groove for a wire.

7. A spring manufacturing machine as claimed in claim 6, wherein a slide for a forming tool is further independently provided.

8. A spring manufacturing machine as claimed in claim 4, wherein a slide for a forming tool is further independently provided.

* * * * *